United States Patent [19]

Ishiguro et al.

[11] Patent Number: 4,528,264

[45] Date of Patent: Jul. 9, 1985

[54] SILVER HALIDE PHOTOGRAPHIC LIGHT-SENSITIVE MATERIALS

[75] Inventors: Shoji Ishiguro; Hiroyuki Mifune; Yoshiharu Fuseya; Tetsuro Kojima, all of Kanagawa, Japan

[73] Assignee: Fuji Photo Film Co., Ltd., Kanagawa, Japan

[21] Appl. No.: 552,224

[22] Filed: Nov. 16, 1983

[30] Foreign Application Priority Data

Nov. 16, 1982 [JP] Japan ..... 57-200626

[51] Int. Cl.[3] ..... G03C 1/34

[52] U.S. Cl. ..... 430/609; 430/630; 430/627; 430/600; 430/941; 430/955

[58] Field of Search ..... 430/609, 630, 627, 600, 430/941, 955

[56] References Cited

U.S. PATENT DOCUMENTS

| | | | |
|---|---|---|---|
| 3,576,638 | 4/1971 | Tuites et al. | 430/609 |
| 3,598,599 | 8/1971 | Tuites et al. | 430/609 |
| 3,598,600 | 8/1971 | Tuites et al. | 430/609 |
| 3,813,250 | 5/1974 | Takamura et al. | 430/609 |
| 4,323,643 | 4/1982 | Mifune et al. | 430/609 |
| 4,397,943 | 8/1983 | Ishiguro et al. | 430/609 |

*Primary Examiner*—Won H. Louie

*Attorney, Agent, or Firm*—Sughrue, Mion, Zinn, Macpeak & Seas

[57] ABSTRACT

A silver halide photographic light-sensitive material is disclosed. The material is comprised of a support base having thereon a silver halide emulsion layer and a high molecular compound having a repeating unit containing a residue of benzotriazoles. The repeating unit may be represented by the general formula (I)

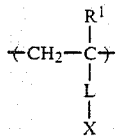

(I)

wherein $R^1$ represents a hydrogen atom or a lower alkyl group, L represents a divalent bonding group, and X represents a monovalent group of benzotriazoles. Improved antifogging agent effects are obtained by utilizing the high molecular compound of applicants' invention in connection with silver halide photographic light-sensitive materials.

15 Claims, No Drawings

SILVER HALIDE PHOTOGRAPHIC LIGHT-SENSITIVE MATERIALS

FIELD OF THE INVENTION

The present invention relates to silver halide photographic light-sensitive materials and, particularly, to silver halide photographic light-sensitive materials containing a high molecular antifogging agent.

BACKGROUND OF THE INVENTION

Benzotriazoles, for example, compounds such as benzotriazole or 5-methylbenzotriazole, etc., have been widely used as antifogging agents for silver halide photographic light-sensitive materials. However, antifogging agents of this kind have properties which allow them to easily diffuse and move between the constituent layers of the photographic light-sensitive materials and easily dissolve in treating solutions. This may take place because their adsorptive power with respect to silver halide is considerably inferior to that of mercapto compounds such as 1-phenyl-5-mercaptotetrazole, etc. Accordingly, it is difficult to prevent fogging of only the specific layer in the photographic light-sensitive material with antifogging agents of this kind. Further, they diffuse more or less into other constituent layers and influence the photographic properties of such layers (for example, reduction of sensitivity). In addition, when they are dissolved and accumulate in the treating solutions, the development becomes difficult to control because they delay the progress of development of the photographic light-sensitive materials to be treated thereafter. Further, they often reduce the spectral sensitivity of the photographic light-sensitive materials when a large amount of such antifogging agents are used for the photographic light-sensitive materials which are to be spectrally sensitized with dyes.

Accordingly, there has been a need to develop benzotriazole antifogging agents without the above faults.

According to the present invention, novel photographic light-sensitive materials which satisfy the above-described requirements can be obtained by providing high polymers of benzotriazoles.

Attempts have been made at producing high polymers of compounds which are known as stabilizers or antifogging agents for silver halide photographic light-sensitive materials. For example, high molecular compounds containing a repeated residual of tetrazoles, thiazoles or imidazoles have been described in U.S. Pat. Nos. 3,576,638, 3,598,599 and 3,598,600. However, the antifogging effect of such compounds as a whole is low, because the residue bonds to the polymer chain through a functional group (for example, mercapto group) which is believed to have the most important influence upon the antifogging function. Further, high molecular compounds having 1-phenyl-5-mercaptotetrazoles which bond to the polymer chain through another group except the mercapto group have been described in U.S. Pat. No. 4,134,768. However, these compounds are not used as a stabilizer or an antifogging agent but are only used as a silver ion scavenger by adding to an intermediate layer for a diffusion transfer process.

Anyhow, antifogging agents which are high polymers of benzotriazoles widely used as the antifogging agent have not been known at all.

SUMMARY OF THE INVENTION

The present invention relates to silver halide photographic light-sensitive materials, wherein at least one layer of the constituent layers contains a high molecular compound having a repeating unit containing a residue of benzotriazoles.

As the above-described high molecular compound, high molecular compounds having a repeating unit represented by the following general formula (I) are preferably used.

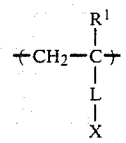

(I)

In the formula, $R^1$ represents a hydrogen atom or a lower alkyl group. L represents a divalent bonding group. X represents a monovalent group of benzotriazoles.

DETAILED DESCRIPTION OF THE INVENTION

The general formula (I) is illustrated in greater detail.

$R^1$ represents a hydrogen atom or a lower alkyl group. As the lower alkyl group, those having 1 to 6 carbon atoms (for example a methyl group, an ethyl group, a butyl group and a hexyl group) are preferred. A hydrogen atom and a methyl group are particularly preferred as $R^1$.

L represents a divalent bonding group, preferably having 1 to 20 carbon atoms. Among such bonding groups, those represented by the following formulae (L-I) and (I-II) are preferred.

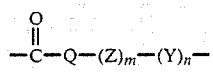

(I-I)

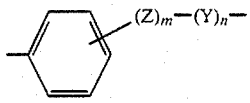

(I-II)

In the formulae, Q represents

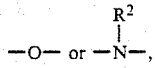

wherein $R^2$ represents a hydrogen atom or a lower alkyl group (those having 6 or less carbon atoms).

Z represents an alkylene group (preferably an alkylene group having 10 or less carbon atoms, which may have an amide bond, an ester bond or an ether bond in the middle, examples of which include a methylene group, an ethylene group, a trimethylene group, a 2-hydroxytrimethylene group, $—CH_2OCH_2—$, $—CH_2CONHCH_2—$ and $—CH_2CH_2OCOCH_2OCH_2—$, etc.) or an arylene group (preferably an arylene group having 6 to 12 carbon atoms, for example, a p-phenylene group, etc.). Y represents —COO—, —OCO—, —CONH—, —NHCO—, $—SO_2NH—$ or $—NHSO_2—$. m and n each represents 0 or an integer of 1.

Particularly preferred divalent bonding groups which L represents include the following groups.

L-1: —CONH—

L-2: —$COOCH_2CH_2OCO$—

L-3: —$COOCH_2CH_2OCOCH_2OCH_2CONH$—

L-4: —COO—

L-5:

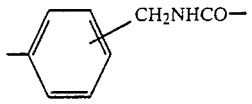

L-6: —$CONHCH_2CH_2CONH$—

L-7: —$COOCH_2CH_2$—

X represents a monovalent group of benzotriazoles, and preferably a group represented by the following general formula (III).

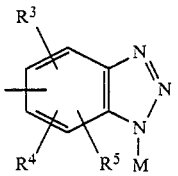

(II)

In the formula, M represents a hydrogen atom, an alkali metal atom (for example, a sodium atom or a potassium atom, etc.) or a protective group which is cleaved by an alkali (for example, an acetyl group, a propionyl group, a pivaloyl group, a stearoyl group, a benzyl group, a p-toluenesulfonyl group, a dodecylcarbamoyl group, a benzoyl group or a cyclohexylcarbamoyl group, etc.). $R^3$, $R^4$ and $R^5$, which may be identical or different, each represents a hydrogen atom, a substituted or nonsubstituted alkyl group (preferably an alkyl group having 12 or less carbon atoms, for example, a methyl group, an ethyl group, a propyl group, a hexyl group, a hydroxyethyl group, a chloropropyl group, a benzyl group or a cyanoethyl group, etc.), a substituted or nonsubstituted aryl group (preferably an aryl group having 6 to 12 carbon atoms, for example, a phenyl group, a naphthyl group, a p-tolyl group, or a p-chlorophenyl group, etc.), a halogen atom (for example, a chlorine atom, or a bromine atom, etc.), a nitro group, a substituted or nonsubstituted alkoxy group (preferably an alkoxy group having 12 or less carbon atoms, for example, a methoxy group, an ethoxy group, an n-butoxy group, a decyloxy group or a hydroxyethoxy group, etc.) or a cyano group.

Particularly preferred examples of X are groups represented by the general formula (II) wherein M represents a hydrogen atom, an alkali metal atom or an acetyl group, and $R^3$, $R^4$ and $R^5$ each represents a hydrogen atom.

The high molecular compound having a repeating unit represented by the formula (I) of the present invention are generally obtained by polymerizing an unsaturated monomer represented by the following general formula (III) itself or by copolymerizing an unsaturated monomer represented by the general formula (III) with ethylenically unsaturated monomers copolymerizable with said monomer.

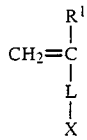

(III)

In the formula, $R^1$, L and X each has the same meaning as that described in the general formula (I).

Examples of monomers represented by the general formula (III) are described in th following.

Monomer III-1:

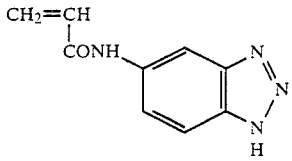

Monomer III-2:

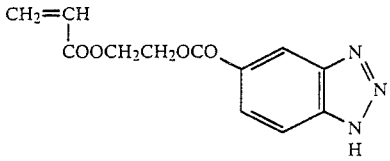

Monomer III-3:

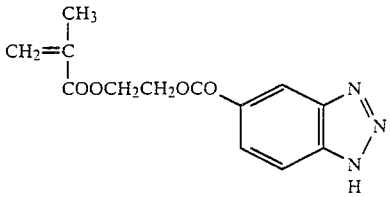

Monomer III-4:

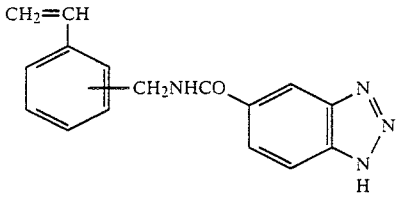

Monomer III-5:

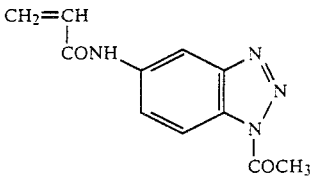

Monomer III-6:

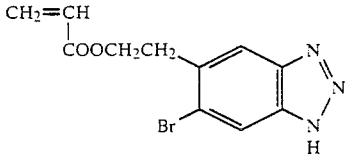

Monomer III-7:

-continued

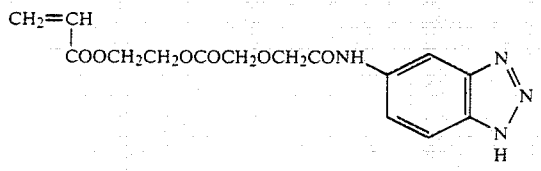

Monomer III-8:

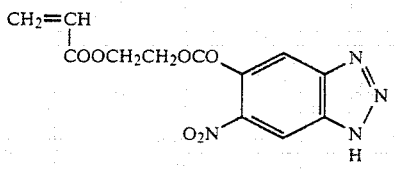

Monomer III-9:

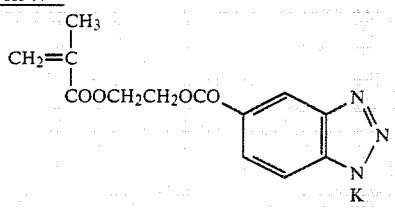

Monomer III-10:

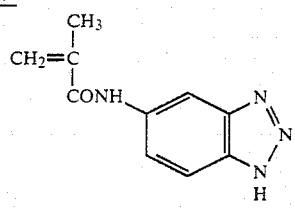

Monomer III-11:

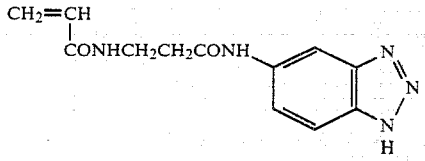

Monomer III-12:

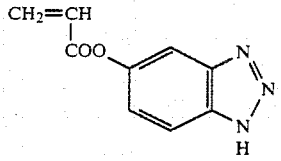

The monomers represented by the general formula (III) can be synthesized generally by condensing a benzotriazole derivative having a carboxyl group, an amino group or a hydroxyl group on the side chain thereof with an unsaturated monomer having an amino group, a hydroxyl group or a carboxyl group.

In the following, examples for synthesizing some monomers represented by the general formula (III) are described. Other monomers which are not described here can be easily synthesized according to these examples.

SYNTHESIS EXAMPLE 1

Synthesis of 5-acryloylaminobenzotriazole (Monomer III-1)

20.7 g of 5-aminobenzotriazole dihydrochloride and 30 g of sodium hydrogen carbonate were dissolved in 300 ml of water, and 10 g of acryl chloride was added dropwise at a temperature of lower than 10° C. over 20 minutes. After being stirred for 1 hour, the formed white precipitate was filtered off. Yield: 13.8 g. It was dissolved in 100 ml of DMF, and 500 ml of hot water at about 70° C. was added. It was immediately filtered under atmospheric pressure. The filtrate was allowed to cool, and the separated crystals were filtered out, washed with water and dried to obtain 11 g of the desired product which melted at 248°–253° C. The structure was confirmed by IR, NMR and elementary analysis.

SYNTHESIS EXAMPLE 2

Synthesis of 1-N-acetyl-5-acryloylaminobenzotriazole (Monomer III-5)

To 40 g of the compound obtained in Synthesis Example 1, 80 ml of acetic acid anhydride and 4 ml of triethylamine were added, and the mixture was stirred at 60° C. for 2 hours. After conclusion of the reaction, the reaction solution was cooled with ice. After 350 ml of water was added, it was poured into 500 ml of water. The separated crystals were filtered off and washed with water. When the resulting crystals were recrystallized from 1.3 l of acetonitrile, 31 g of the desired product which melted at 167°–170° C. was obtained. The structure was confirmed by IR, NMR and elementary analysis.

The high molecular compounds of the present invention may be those prepared by polymerizing the monomer represented by the general formula (III) itself or may be copolymers of the monomer represented by the general formula (III) and one or more ethylenically unsaturated monomers copolymerizable with said monomer.

Examples of the ethylenically unsaturated monomers used in the present invention include ethylene, propylene, 1-butene, isobutene, styrene, chloromethylstyrene, hydroxymethylstyrene, potassium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzylvinylpyridinium chloride, N-vinylacetamine, N-vinylpyrrolidone, 2-methyl-3-methylimidazole, monoethylenically unsaturated esters of aliphatic acids (for example, vinyl acetate and allyl acetate), ethylenically unsaturated monocarboxylic acids or dicarboxylic acids (for example, acrylic acid, methacrylic acid, itaconic acid and maleic acid), maleic acid anhydride, esters of ethylenically unsaturated monocarboxylic acids or dicarboxylic acids (for example, n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium p-toluenesulfonate, N,N-diethyl-N-methyl-N-methacryloyloxyethylammonium p-toluenesulfonate, dimethyl itaconate and monobenzyl maleate), and amides of ethylenically unsaturated monocarboxylic acids or dicarboxylic acids (for example, acrylamide, N,N-dimethyl-N'-methacryloylpropanedimaineacetate betaine, N,N-dimethyl-N'-acryloylpropanediamine propionate betaine, N,N-dimethylacrylamide, N-methylolacrylamide, N-(N,N-dimethylaminopropyl)acrylamide, N,N,N-trimethyl-N-(N-acryloylpropyl)ammonium p-toluenesulfonate, sodium 2-acrylamide-2-methylpropanesulfonate, acryloylmorpholine, sodium 2-acrylamide-2-methylpropanesulfonate and methacrylamide), etc.

Among these ethylenically unsaturated monomers, monoethylenically unsaturated esters of aliphatic acids and saponified products thereof, sodium 2-acrylamide-2-methylpropanesulfonate, N-vinylpyrrolidone, esters of ethylenically unsaturated monocarboxylic acids (for example, hydroxyethyl acrylate and hydroxyethyl methacrylate), amides of ethylenically unsaturated monocarboxylic acids (for example, acrylamide and methacrylamide) and salts of vinylbenzenesulfonate, etc., are preferred.

The degree of polymerization of the high molecular compounds of the present invention may be suitably selected. Although it is not easy to correctly determine the molecular weight of these compounds, the molecular weight is preferably in a range of about $5\times10^3$ to $3\times10^6$ measured by a light scattering method or a GPC method.

When using copolymers of the ethylenically unsaturated monomers, the ratio of copolymerization can be suitably selected. However, the effect of the present invention is further obtained if the molar percentage of the repeating unit represented by the general formula (I) in the copolymers is 0.1% or more and preferably 1% or more.

In the following, examples of the high molecular compound of the present invention are described.

In the following formulae, designations (1-1), (1-2), (1-3) and the like designate different polymers where the mol% of x and y vary.

Polymer 1:

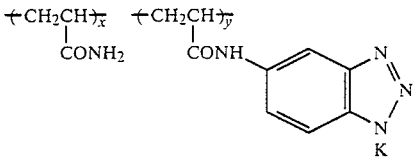

| | 1-1 | 1-2 | 1-3 | 1-4 | 1-5 |
|---|---|---|---|---|---|
| x: | 95 | 90 | 80 | 70 | 0 |
| y: | 5 | 10 | 20 | 30 | 100 |

("x" and "y" show mol %, hereinafter the same)

Polymer 2:

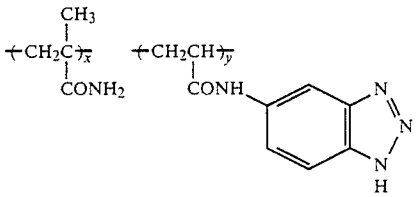

| | 2-1 | 2-2 |
|---|---|---|
| x: | 95 | 90 |
| y: | 5 | 10 |

Polymer 3:

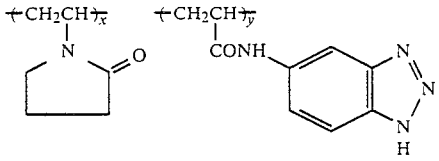

| | 3-1 | 3-2 |
|---|---|---|
| x: | 95 | 90 |

-continued

| | | |
|---|---|---|
| y: | 5 | 10 |

Polymer 4:

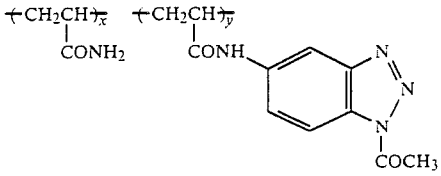

| | 4-1 | 4-2 | 4-3 |
|---|---|---|---|
| x: | 95 | 90 | 0 |
| y: | 5 | 10 | 100 |

Polymer 5:

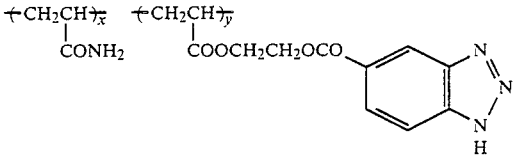

| | 5-1 | 5-2 | 5-3 |
|---|---|---|---|
| x: | 95 | 90 | 80 |
| y: | 5 | 10 | 20 |

Polymer 6:

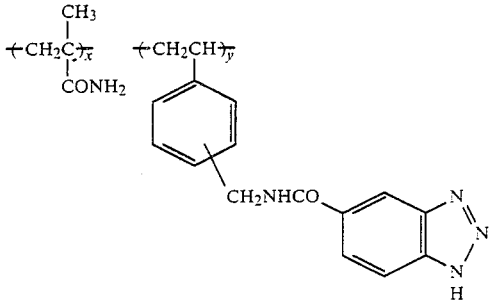

| | 6-1 | 6-2 |
|---|---|---|
| x: | 95 | 90 |
| y: | 5 | 10 |

Polymer 7:

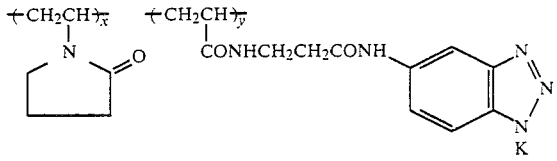

| | 7-1 | 7-2 |
|---|---|---|
| x: | 90 | 80 |
| y: | 10 | 20 |

Polymer 8:

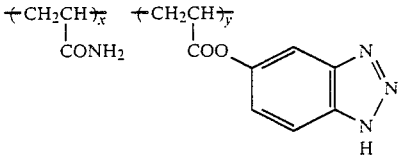

| | 8-1 | 8-2 |
|---|---|---|
| x: | 95 | 90 |
| y: | 5 | 10 |

Polymer 9:

-continued

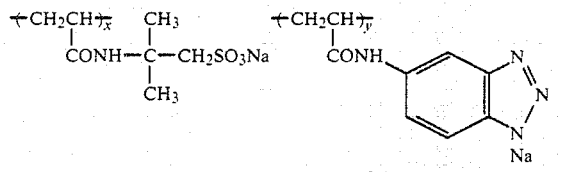

9-1

| | |
|---|---|
| x: | 90 |
| y: | 10 |

Polymer 10:

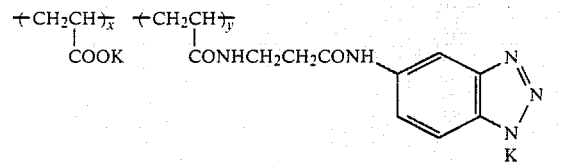

10-1

| | |
|---|---|
| x: | 80 |
| y: | 20 |

Polymer 11:

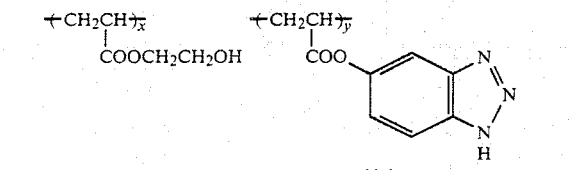

11-1

| | |
|---|---|
| x: | 90 |
| y: | 10 |

Homopolymerization of the monomer represented by the general formula (III) and copolymerization of it with other ethylenically unsaturated monomers are carried out according to, for example, a process by Ronald L. Schnaar and Yuan Chan Lee, described in *Biochemistry,* page 1535 (1975), a process by Anthony Winston and Glenn R. Mclaughlin, described in *Journal of Polymer Science; Polymer Chemistry Edition,* page 2155 (1976), a process by Hans-Georg Batz and Johanna Koldehotf, described in *Die Makromolekule Chemie,* Volume 177, page 683 (1976), a process by Hans-Geo Batz, Giselner Franzmann and Helmut Ringsdorf, described in *Angewante Chemie; Internat. Edit.,* page 1103 (1972) and a process by P. Ferruti, A. Betelli and Angelino Fere, described in *Polymer,* page 462 (1972).

In the following, processes for synthesizing typical high molecular compound are described in detail.

SYNTHESIS EXAMPLE 3

Synthesis of poly(acrylamide-co-1-N-acetyl-5-acryloylaminobenzotriazole) (Polymer 4-1)

27.0 g of acrylamide and 4.6 g of 1-N-acetyl-5-acryloylaminobenzotriazole were dissolved in 320 ml of tetrahydrofuran, and the solution was heated to 62° C. To the solution 990 mg of 2,2'-azobis-2,4-dimethylvaleronitrile (polymerization initiator marketed as the trade name: V-65 by Wako Junyaku Co.) was added. After being stirred for 2 hours, it was allowed to cool to room temperature. The separated precipitate was filtered off and dried to obtain 30 g of a white polymer (the desired product).

SYNTHESIS EXAMPLE 4

Synthesis of poly(acrylamide-co-5-acryloylaminobenzotriazole K salt) (Polymer 1-1)

100 ml of water was added to 22 g of the polymer obtained in Synthesis Example 3 and, 10 ml of a 1 normal solution of potassium hydroxide was added little by little. The solution was stirred at room temperature. It was poured into 1 liter of methanol to cause reprecipitation, and the precipitate was filtered off. The resulting precipitate was put in 100 ml of water, and it was acidified with concentrated hydrochloric acid. After 10 ml of a 1 normal solution of potassium hydroxide was added with stirring, the solution was dialyzed. After dialysis was carried out it was concentrated to 150 ml under reduced pressure and poured in methanol to cause reprecipitation. The precipitate was filtered off and dried to obtain 12 g of a white polymer (the desired product).

SYNTHESIS EXAMPLE 5

Synthesis of poly(methacrylamide-co-5-N-vinylbenzylcarbamoylbenzotriazole) (Polymer 6-2)

6.4 g of methacrylamide and 2.8 g of 5-N-vinylbenzylcarbamoylbenzotriazole were dissolved in 70 ml of tetrahydrofuran, and the solution was heated to 60° C. After 250 mg of v-65 was added, it was stirred for 2 hours. After the conclusion of the reaction, it was allowed to cool to room temperature, and the separated precipitate was filtered off and dried to obtain 5.1 g of a white polymer (the desired product).

The other high molecular compounds can be easily synthesized according to the above-described Synthesis Examples.

The high molecular compounds of the present invention are added to at least one layer of the constituent layers of the photographic light-sensitive materials, but the most suitable layer to be added is a silver halide emulsion layer. The time of addition is not particularly restricted, and they may be added at any times, for example, during production of the emulsion or during application of the emulsion according to the desired end purpose. Further, examples of layers to which the high molecular compound of the present invention can be added are various supplementary layers such as a top coating layer, a protective layer, an intermediate layer, an undercoating layer or a filter layer, etc., in addition to the silver halide emulsion layers.

When the bonding group L is easily cleaved by alkali, the high molecular compounds of the present invention can become a precursor of benzotriazoles. In such a case, they are sometimes preferably added to layers other than silver halide emulsion layers.

The high molecular compounds of the present invention can be used alone as an antifogging agent, but they may be used together with other known antifogging agents. For example, it is preferred to use the high molecular compounds of the present invention together with benzotriazoles (for example, 5-methylbenzotriazole, 5-nitrobenzotriazole or 5-chlorobenzotriazole, etc.). Because, fogging can be greatly prevented without having undesirable secondary effects since both of them have in principle the same mechanism of preventing fog of silver halide. Further, reduction of spectral sensitivity or pollution of treating solutions, which is caused by dissolving benzotriazoles and accumulating therein when requiring a large amount of benzotriazoles, can be solved without deterioration of the antifogging effect.

Accordingly, the amount of the high molecular compounds of the present invention to be used is not particularly restricted and it can be selected over a wide range. However, it is generally preferred to use the compounds of the invention in a range of $10^{-8}$ mol to $10^{-3}$ mol, preferably $10^{-7}$ mol to $5\times10^{-4}$ mol, calculated as the number of mols of the residue of benzotriazoles contained in the high molecular compound, on the basis of 1 $m^2$ of the base. With respect to the weight of the high molecular compounds, it is preferred to use the compound in a range of about 0.02 mg to about 2 g, preferably about 0.2 mg to about 1 g, on the basis of 1 $m^2$ of the base; or a range from about 60 mg to about 200 g, preferably about 300 mg to about 100 g, per mol of silver halide.

As the conventional antifogging agents and stabilizers used together with the high molecular compounds of the present invention, there are many compounds which are known as the antifogging agent or stabilizer, such as azaindenes (particularly 4-hydroxy-6-methyltetraazaindene, etc.); azoles such as benzothiazolium salts, nitroindazoles, triazoles or benzimidazoles (particularly nitro- or halogen substituted compounds); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole) or mercaptopyrimidines; the above-described heterocyclic mercapto compounds having water solubilizing groups such as carboxyl group or sulfonic acid group, etc.; thioketo compounds such as oxazolinethione; benzenethiosulfonic acids; or benzenesulfinic acids, etc., in addition to the above-described benzotriazoles.

In the photographic emulsions in the photographic light-sensitive materials of the present invention, any of silver bromide, silver iodobromide, silver iodochlorobromide, silver chlorobromide and silver chloride may be used as the silver halide.

Silver halide particles in the photographic emulsions may have a regular crystal form such as a cube or octahedron; an irregular crystal form such as a sphere or plate; or a composite crystal form of them. Further, they may be composed of a mixture of particles having different crystal forms.

The silver halide particles may have a structure in which the inner part and the surface layer each have a different phase or may be composed of a homogeneous phase. Further, they may be particles wherein latent images are chiefly formed on the surface or may be particles wherein the latent images are chiefly formed in the inner parts.

The photographic emulsions used in the present invention can be prepared by processes described in *Chimie et Physique Photographique,* written by P. Glafkides (published by Paul Montel Co., 1967); *Photographic Emulsion Chemistry,* written by G. F. Duffin (published by The Focal Press, 1966); and *Making and Coating Photographic Emulsion,* written by V. L. Zelikman et al. (published by The Focal Press, 1964), etc.

Formation of silver halide particles or physical ageing may be carried out in a presence of cadmium salts, zinc salts, lead salts, thallium salts, iridium salts or complex salts thereof, rhodium salts or complex salts thereof, or iron salts or complex salts thereof, etc.

In the present invention, negative type emulsions which form surface latent images and direct reversal emulsions can be used, too. As the latter emulsions, there are internal latent image type emulsions and previously fogged direct reversal emulsions.

Examples of the internal latent image type silver halide emulsions capable of being advantageously used in the present invention include conversion type emulsions, core/shell type emulsion and emulsions containing a different kind of metal, etc., described in U.S. Pat. Nos. 2,592,250, 3,206,313, 3,447,927, 3,761,276 and 3,935,014, etc.

Typical examples of the nucleus forming agents for this kind of emulsions include hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Publication No. 38164/74 and U.S. Pat. Nos. 3,734,738, 3,719,494 and 3,615,615, etc.; sensitizing dyes having a substituent which has a nucleating function in the dye molecule, described in U.S. Pat. No. 3,718,470; and acylhydrazinophenylthiourea compounds described in U.S. Pat. Nos. 4,030,925 and 4,031,127.

As binders or protective colloids in the photographic emulsions, gelatin is advantageously used, but other hydrophilic colloids can be used, too.

For example, it is possible to use proteins such as gelatin derivatives, graft polymers of gelatin with other high polymers, albumin or casein, etc.; sugar derivatives such as cellulose derivatives such as hydroxyethyl cellulose, carboxymethyl cellulose or cellulose sulfate, etc., sodium alginate or starch derivatives, etc.; and synthetic hydrophilic high molecular substances such as homo- or copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole, etc.

As gelatin, it is possible to use not only lime-treated gelatin but also acid-treated gelatin and enzyme-treated gelatin described in *Bull. Soc. Sci. Phot. Japan,* No. 16, page 30 (1966). Further, hydrolyzed products and enzyme decomposition products of gelatin can be used, too.

The surface and/or the inside of particles of silver halide emulsions used in the present invention may be chemically sensitized. In order to carry out chemical sensitization, it is possible to use, for example, a process described in *Die Grundlagen der Photographischen Prozesse mit Silberhalogeniden,* edited by H. Frieser (Akademische Verlagsgesellschaft, 1968) pages 675–734.

Namely, a sulfur sensitization process using sulfur containing compounds capable of reacting with active gelatin or silver (for example, thiosulfates, thioureas, mercapto compounds and rhodanines); a reduction sensitization process using reducing substances (for example, stannous salts, amines, hydrazine derivatives, formamidinesulfinic acid and silane compounds); and a noble metal sensitization process using noble metal compounds (for example, gold complex salts, and complex salts of metals of Group VIII in the Periodic Table, such as Pt, Ir or Pd, etc.) can be used alone or as a combination of them.

Examples of the sulfur sensitization process have been described in U.S. Pat. Nos. 1,574,944, 2,410,689, 2,278,947, 2,728,668 and 3,656,955, examples of the reduction sensitization process have been described in U.S. Pat. Nos. 2,983,609, 2,419,974 and 4,054,458, etc., and examples of the noble metal sensitization process have been described in U.S. Pat. Nos. 2,399,083, 2,448,060 and British Pat. No. 618,061, etc.

Further, the process described in Japanese Patent Publication No. 34213/77 can be utilized for surface chemical sensitization of the internal latent image type silver halide particles. If the emulsions of this type are core/shell type ones, it is possible to utilize a surface chemical sensitization process in a presence of a specific polymer described in Japanese Patent Application (OPI) No. 136641/82 (the term "OPI" as used herein refers to a "published unexamined Japanese patent application").

The photographic emulsions used in the present invention may be spectrally sensitized with methine dyes and others. Examples of useful sensitizing dyes are those described in German Pat. No. 929,080, U.S. Pat. Nos. 2,493,748, 2,503,776, 2,519,001, 2,912,329, 3,656,959, 3,672,897, 3,694,217, 4,025,349 and 4,046,572, British Pat. No. 1,242,588 and Japanese Patent Publications Nos. 14030/69 and 24844/77. These sensitizing dyes can be used alone, but they may be used as a combination of them. The combinations of the sensitizing dyes are frequently used for the purpose of, particularly, supersensitization. Typical examples of them have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862 and 4,026,707, British Pat. Nos. 1,344,281 and 1,507,803, Japanese Patent Publications Nos. 4936/68 and 12375/78 and Japanese Patent Applications (OPI) Nos. 110618/77 and 109925/77.

The emulsions may contain dyes which do not have a spectrally sensitizing function themselves or substances which do not substantially absorb visible rays but show supersensitization function. For example, they may contain aminostilbene compounds substituted with nitrogen containing heterocyclic groups (for example, those described in U.S. Pat. Nos. 2,933,390 and 3,635,721), aromatic organic acid-formaldehyde condensation products (for example, those described in U.S. Pat. No. 3,743,510), cadmium salts or azaindene compounds. Combinations described in U.S. Pat. Nos. 3,615,613, 3,615,641, 3,617,295 and 3,635,721 are particularly useful.

In the photographic light-sensitive materials of the present invention, the photographic emulsion layers and other hydrophilic colloid layers may contain inorganic or organic hardening agents. For example, it is possible to use chromium alum, chromium acetate, formaldehyde, glyoxal, glutaraldehyde, dimethylolurea, methylol dimethylhydantoin, 2,3-dihydroxydioxane, 1,3,5-triacryloyl-hexahydro-s-triazine, 1,3-vinylsulfonyl-2-propanol, 2,4-dichloro-6-hydroxy-s-triazine, mucochloric acid and mucophenoxychloric acid, etc., which may be used alone or as a combination of them.

The photographic emulsion layers or other hydrophilic colloid layers in the light-sensitive materials of the present invention may contain various surface active agents as a coating aid or for various purposes, for example, prevention of static charges, improvement of lubrication, acceleration of emulsification and dispersion, prevention of adhesion and improvement of photographic characteristics (for example, development acceleration, hard toning and sensitization), etc.

For example, it is possible to use nonionic surface active agents such as saponin (steroid type), polyethylene glycol, polyethylene glycol/polypropylene glycol condensation product, polyethylene glycol alkyl ethers, polyethylene glycol alkylaryl ethers, polyethylene glycol esters, polyethylene glycol sorbitan esters, polyalkylene glycol alkylamines or amides, polyethylene oxide addition products of silicone, alkenylsuccinic acid polyglyceride or alkylphenol polyglyceride, etc.; anionic surface active agents such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkyl polyoxyethylene alkylphenyl ethers or polyoxyethylene alkylphosphoric acid esters, etc.; ampholytic surface active agents such as amino acids, aminoalkylsulfonic acids, aminoalkylsulfuric or phosphoric acid esters, alkylbetaines or amine oxides, etc.; and cationic surface active agents such as alkylamine salts, aliphatic or aromatic quaternary ammonium salts, hetero cyclic quaternary ammonium salts such as pyridinium salts or imidazolium salts, etc., or aliphatic or heterocyclic phosphonium or sulfonium salts, etc.

In the photographic light-sensitive materials of the present invention, the photographic emulsion layers and other hydrophilic colloid layers may contain dispersions of water-insoluble or poorly soluble synthetic polymers for the purpose of improving dimensional stability. For example, it is possible to use polymers composed of one or more of alkyl acrylate, alkyl methacrylate, alkoxyalkyl acrylate, alkoxyalkyl methacrylate, glycidyl acrylate, glycidyl methacrylate, acrylamide, methacrylamide, vinyl acetate, acrylonitrile, olefin and styrene, etc., and polymers composed of the above-described monomers and acrylic acid, methacrylic acid, $\alpha,\beta$-unsaturated dicarboxylic acid, hydroxyalkyl acrylate, hydroxyalkyl methacrylate, sulfoalkyl acrylate, sulfoalkyl methacrylate or styrene sulfonic acid, etc.

The photographic emulsion layers in the photographic light-sensitive materials of the present invention may contain, for example, polyalkylene oxide or derivatives thereof such as ethers, esters or amides, etc., thioether compounds, thiomorpholines, quaternary ammonium compounds, urethane derivatives, urea derivatives, imidazole derivatives and 3-pyrazolidones, etc., for the purpose of increasing sensitivity, increasing contrast or accelerating development.

In the photographic light-sensitive materials of the present invention, it is possible to add other additives such as photographic dyes, ultraviolet ray absorbing agents, fluorescent whitening agents, lubricating agents, or matting agents, etc. Details of these additives have been described in *Research Disclosure*, Vol. 176, pages 22–31, together with the above-described additives.

The photographic light-sensitive materials of the present invention can be used as black-and-white photographic light-sensitive materials and as color photographic light-sensitive materials. When using the photographic light-sensitive materials of the present invention as the color photographic light-sensitive materials, various dye image-providing compounds are used. These dye image-providing compounds may be compounds used for conventional color photography or may be compounds used for color photography in the diffusion transfer process.

The dye image-providing compounds used for conventional color photography mean color forming couplers, namely, compounds which are capable of coloring in color development by an oxidation coupling reaction with aromatic primary amine developing agents (for example, phenylenediamine derivatives or aminophenol derivatives, etc.). Examples of magenta couplers include 5-pyrazolone couplers, pyrazolobenzimidazole couplers, cyanoacetylcumarone couplers and open-chain acylacetonitrile couplers, etc. Examples of yellow couplers include acylacetamide couplers (for example, benzoylacetanilides and pivaloylacetanilides), etc. Examples of cyan couplers include naphthol couplers and phenol couplers, etc. It is desirable that these couplers are indiffusible substances which have a hydrophobic group called a ballast group in the molecule. The couplers may be 4-equivalent to silver ions or may be 2-equivalent. Further, they may be colored couplers which have an effect of color correction or may be couplers which release a development inhibitor by the development (the so-called DIR coupler). Further, they may include non-coloring DIR coupling compounds which release a development inhibitor, the product of which by a coupling reaction is colorless.

Anti-color-fogging agents such as hydroquinone derivatives, aminophenol derivatives, gallic acid derivatives or ascorbic acid derivatives, etc., may be contained together with the above-described color forming couplers.

Further, in the present invention, known antifading agents can be used alone or as a mixture of them. Examples of the known antifading agents include hydroquinone derivatives, gallic acid derivatives, p-alkoxyphenols, p-oxyphenols and bisphenols, etc.

As the dye image-providing compounds used for color photography in the diffusion transfer process used in the present invention, various compounds can be used, but couplers and dye releasing redox compounds are particularly useful.

Among the dye releasing redox compounds, examples of redox compounds wherein the compound which is subjected to oxidation releases a dye by alkali hydrolysis include those described in the following literature.

U.S. Pat. Nos. 4,053,312, 4,055,428, 4,076,529, 4,152,153 and 4,135,929, Japanese Patent Applications (OPI) Nos. 149328/78, 104343/76, 46730/78, 130122/79 and 3819/78, and Japanese Patent Applications (OPI) Nos. 12642/81, 16130/81 and 16131/81, etc.

Further, examples of redox compounds wherein the compound which is not subjected to oxidation releases a dye by ring closure include those described in the following literature.

U.S. Pat. Nos. 4,139,379 and 3,980,479, and German Patent Applications (OLS) Nos. 2,402,900 and 2,448,811, etc.

Further, couplers used for color photography in the diffusion transfer process have been described in, for example, *The Theory of Photographic Process,* (4th Edition, 1977, edited by T. H. James), Chapter 12.

The above-described dye image-providing compounds can be dispersed in hydrophilic colloids as the carrier by various known methods.

The photographic light-sensitive materials of the present invention can be used for, for example, the following various uses.

Namely, there are color positive light-sensitive materials, light-sensitive materials for color paper, color negative light-sensitive materials, color reversal light-sensitive materials (which may contain or not contain couplers), photographic light-sensitive materials for plate making (for example, lithographic films, etc.), light-sensitive materials for cathode-ray tube display, X-ray recording light-sensitive materials (particularly, materials for directly or indirectly photographing using a screen), colloid transfer processes (which are described in, for example, U.S. Pat. No. 2,716,059), light-sensitive materials for the silver salt diffusion transfer process (which are described in, for example, U.S. Pat. Nos. 2,352,014, 2,543,181 and 3,020,155, etc.), light-sensitive materials for the color diffusion transfer process (which are described in U.S. Pat. Nos. 3,087,817, 3,185,567, 2,983,606 and 3,253,915, and *Research Disclosure,* Vol. 151, No. 15162, pp. 75–87 (1976, November), etc.), light-sensitive materials for the dye transfer process (imbibition transfer process) (which are described in U.S. Pat. No. 2,882,156, etc.), light-sensitive materials for the silver dye bleaching process (which are described in Friedman, *History of Color Photography,* American Photographic Publishers Co., 1944, particularly Chapter 24), etc.), direct positive light-sensitive materials (which are described in, for example, U.S. Pat. Nos. 2,497,875, 2,588,982, 3,367,778 and 3,501,306, etc.), light-sensitive materials for thermal development (which are described in, for example, U.S. Pat. Nos. 3,152,904 and 3,312,550, etc.) and light-sensitive materials for physical development (which are described in, for example, British Pat. Nos. 920,277 and 1,131,238, etc.), etc.

The photographic light-sensitive materials of the present invention are advantageously used as coupler-in-emulsion type color photographic materials having a multilayer construction (particularly, reversal color photographic materials and negative color photographic materials), white-and-black high speed negative photographic materials, photographic materials for the color diffusion transfer process and direct positive photographic materials.

Exposure to light for obtaining photographic images is carried out by conventional manners. Namely, it is possible to use any of known various light soruces such as natural light (sunlight), tungsten lamps, fluorescent lamps, mercury lamps, xenon-arc lamps, laser light, carbon-arc lamps, xenon flash light or flying spots of cathode-ray tubes, etc.

In order to carry out photographic processing of the light-sensitive materials of the present invention, it is possible to use any of the known processes and known treating solutions, for example, those described in *Research Disclosure,* Vol. 176, pages 28–30 (RD-17643) and *Photographic Science and Engineering,* Vol. 20, No. 4, pages 155–160 (July, August 1976). The photographic processing may be any of photographic processing of forming silver images (black-and-white photographic processing) and photographic processing of forming dye images (color photographic processing). The treating temperature is selected generally from the range of 18° C. to 50° C., but it may be lower than 18° C. or higher than 50° C.

The so-called "litho type" development processing can be applied to the photographic emulsions of the present invention. The term "litho type" development processing means development processing in which the development is infectiously carried out using dihydroxybenzenes as the developing agent under a low sulfuric acid ion concentration in order to carry out photographic reproduction of linear images or photographic reproduction of halftone images by dots. (Details are described in *Photographic Processing Chemistry,* pages 163–165 (1966), written by Mason).

The developing solution used in case of the black-and-white photographic processing can contain known developing agents. As the developing agents, dihydroxybenzenes (for example, hydroquinone), 3-pyrazolidones (for example, 1-phenyl-3-pyrazolidone) and aminophenols (for example, N-methyl-p-aminophenol), etc., can be used alone or as a combination of them. In addition, the developing solution generally contains known preservatives, alkali agents, pH buffer agents and antifogging agents, etc., and it may contain, if desired, dissolution assistants, toning agents, development accelerators, surface active agents, defoaming agents, water softeners, hardeners and thickeners, etc.

As the fixing solution, solutions having a conventionally used composition can be used. As a fixing agent, it is possible to use not only thiosulfates and thiocyanates but also organic sulfur compounds which are known to have an effect as a fixing agent. The fixing solution may contain water-soluble aluminum salts as a hardener.

The color developing solution for forming dye images is generally composed of an aqueous alkaline solution containing a color developing agent. As the color developing agents, it is possible to use known primary aromatic amine developing agents, such as phenylenediamines (for example, 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline and 4-amino-3-methyl-N-ethyl-N-$\beta$-methoxyethylaniline, etc.).

Moreover, substances described in *Photographic Processing Chemistry,* pages 226–229, written by L. F. A. Mason (Focal Press, 1966), U.S. Pat. Nos. 2,193,015 and 2,592,364, and Japanese Patent Application (OPI) No. 64933/73, etc., may be used.

In addition, the color developing solution can contain pH buffer agents, development inhibitors or antifogging agents, etc. Further, if desired, it may contain water hardeners, preservatives, organic solvents, development accelerators, dye forming couplers, competing couplers, fogging agents, auxiliary developing agents, thickeners, polycarboxylic acid type chelate agents and antioxidants, etc.

In the following, the present invention is illustrated in greater detail with reference to examples. However, the scope of the invention is not limited to these examples.

EXAMPLE 1

To a silver iodobromide gelatin emulsion containing 6% by mol of silver iodide (average particle size of silver halide particles: about 0.8$\mu$), 5 mg of sodium thiosulfate, 3.5 mg of potassium chloroaurate and 0.18 g of ammonium rhodanide based on 1 mol of silver were added, and the emulsion was aged at 62° C. for 60 minutes.

Then, to this emulsion high molecular compounds of the present invention and comparative compounds were added as shown in Table 1, respectively. Further, coating aids (sodium dodecylbenzenesulfonate and sodium p-nonylphenoxypoly(ethyleneoxy)propanesulfonate) and a hardener (1,3-bisvinylsulfonylhydroxypropane) were added. The emulsions were applied to cellulose triacetate bases and dried to obtain Samples 1 to 17.

Three groups of these Samples 1 to 17 were preserved in a refrigerator at 5° C., in an atmosphere at 50° C. and a relative humidity of 20% and in an atmosphere at 50° C. and a relative humidity of 80%, for 7 days, respectively. Thereafter, these three groups of samples were exposed to light through an optical wedge by a sensitometer (1/20 second), developed at 32° C. for 2 minutes with a developing solution having the following composition, and fixed by a conventional method. After they were washed with water and dried, photographic properties (sensitivity and fog) were measured to obtain results shown in Table 1.

Further, the photographic sensitivity is indicated as the reciprocal of logarithm of an exposure amount necessary to obtain an optical density of fog +0.2, which is shown in Table 1 as a relative value on the basis of the sensitivity of Sample 1 as being 100.

Composition of the Developing Solution:

N-Methyl-p-aminophenol hemisulfate: 1.55 g
Hydroquinone: 6 g
Anhydrous sodium sulfite: 22.5 g
Sodium carbonate monohydrate: 39.5 g
Potassium bromide: 0.95 g
Water to make: 1 l Further, the following compounds were used as the comparative compounds.

Comparative Compound A:

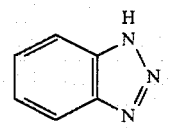

Comparative Compound B: (Monomer III-1)

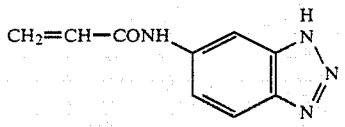

Comparative Compound C:
Polyacrylamide

Comparative Compound D:
Polyvinylpyrrolidone

TABLE 1

| Sample No. | Compound Added | Amount Added (g/mol AgX) | Relative Sensitivity: In Refrigerator (5° C.) for 7 Days | Relative Sensitivity: At 50° C., 20% RH for 7 Days | Relative Sensitivity: At 50° C., 80% RH for 7 Days | Fog: In Refrigerator (5° C.) for 7 Days | Fog: At 50° C., 20% RH for 7 Days | Fog: At 50° C., 80% RH for 7 Days |
|---|---|---|---|---|---|---|---|---|
| 1 | (control) | — | 100 | 146 | 66 | 0.12 | 0.31 | 0.18 |
| 2 | Comparative Compound A | 0.43 | 95 | 144 | 66 | 0.12 | 0.28 | 0.18 |
| 3 | Comparative Compound A | 1.29 | 93 | 140 | 66 | 0.12 | 0.21 | 0.18 |
| 4 | Comparative Compound A | 3.87 | 90 | 135 | 66 | 0.12 | 0.20 | 0.16 |
| 5 | Comparative Compound B | 0.68 | 91 | 120 | 64 | 0.12 | 0.21 | 0.15 |
| 6 | Comparative | 2.04 | 79 | 83 | 64 | 0.10 | 0.14 | 0.14 |

TABLE 1-continued

| Sample No. | Compound Added | Amount Added (g/mol AgX) | Relative Sensitivity: In Refrigerator (5° C.) for 7 Days | Relative Sensitivity: At 50° C., 20% RH for 7 Days | Relative Sensitivity: At 50° C., 80% RH for 7 Days | Fog: In Refrigerator (5° C.) for 7 Days | Fog: At 50° C., 20% RH for 7 Days | Fog: At 50° C., 80% RH for 7 Days |
|---|---|---|---|---|---|---|---|---|
| 7 | Compound B Comparative | 21.3 | 100 | 146 | 55 | 0.12 | 0.36 | 0.21 |
| 8 | Compound C Comparative | 12.1 | 79 | 140 | 60 | 0.21 | 0.28 | 0.22 |
| 9 | Compound D Polymer 1-5 | 0.34 | 100 | 146 | 66 | 0.12 | 0.20 | 0.16 |
| 10 | Polymer 1-5 | 1.02 | 98 | 140 | 66 | 0.10 | 0.16 | 0.15 |
| 11 | Polymer 1-2 | 0.78 | 98 | 144 | 74 | 0.12 | 0.15 | 0.12 |
| 12 | Polymer 1-2 | 3.13 | 85 | 107 | 78 | 0.10 | 0.12 | 0.10 |
| 13 | Polymer 1-1 | 5.70 | 98 | 146 | 75 | 0.10 | 0.12 | 0.10 |
| 14 | Polymer 1-1 | 17.10 | 91 | 128 | 79 | 0.08 | 0.10 | 0.08 |
| 15 | Polymer 3-2 | 12.10 | 82 | 115 | 68 | 0.10 | 0.12 | 0.10 |
| 16 | Polymer 5-3 | 8.20 | 78 | 102 | 62 | 0.11 | 0.12 | 0.11 |
| 17 | Polymer 6-2 | 7.50 | 95 | 140 | 60 | 0.12 | 0.21 | 0.16 |

As is obvious from Table 1, the compounds of the present invention show an antifogging function and a stabilizing function equal to or higher than those of Comparative Compounds A and B, even if preserved under the condition of 50° C. and 20% RH or 50° C. and 80% RH for 7 days. It is understood that they effectively function even though they are high polymers.

EXAMPLE 2

In order to examine an elution rate of the compounds from the coating films, Sample Nos. 4, 6, 10, 12 and 15 in Example 1 were immersed in an alkali solution having pH 10.5 (sodium carbonate 50 g, KBr 3 g and $H_2O$ up to 1 l, the pH was adjusted to 10.5 with acetic acid) at 32° C. for 5 minutes, and the elution rate was measured by UV absorption. Results are shown in Table 2.

TABLE 2

| Sample No. in Example 1 | Elution Rate (%) |
|---|---|
| No. 4* | about 38 |
| No. 6* | about 30 |
| No. 10** | about 10 |
| No. 12** | about 13 |
| No. 15** | about 15 |

*Comparison
**Invention

As is obvious, elution of the high molecular compounds of the present invention into the alkali solution is remarkably low as compared with the comparative compounds, and it is understood that they have an advantage of causing less pollution of the treating solution.

EXAMPLE 3

To a paper base the both sides of which were laminated with polyethylene (having a titanium dioxide white reflection layer), the 1st layer (the lowest layer) to the 4th layer (the top layer) were applied as shown below to produce a multilayer color light-sensitive material.

| | |
|---|---|
| The 4th layer (protective layer) | Gelatin |
| The 3rd layer (green-sensitive layer) | Sulfur sensitized silver chlorobromide emulsion (silver bromide 70% by mol)<br>Silver: 420 mg/m$^2$<br>Gelatin 1,500 mg/m$^2$<br>Magenta coupler [1-(2,4,6-trichlorophenyl)-3-(2-chloro-5-tetradecanamide)-anilino-2-pyrazolino-5-one]<br>480 mg/m$^2$<br>Coupler solvent (o-cresyl phosphate)<br>480 mg/m$^2$<br>Spectrally sensitizing dye (5,5'-diphenyl-9-ethyl-3,3'-di(3-sulfopropyl)-oxacarbocyanine sodium salt)<br>1.5 mg/m$^2$ |
| The 2nd layer (intermediate layer) | Gelatin 1,000 mg/m$^2$ |
| The 1st layer (blue-sensitive layer) | Sulfur sensitized silver chlorobromide emulsion (silver bromide 80% by mol)<br>Silver: 420 mg/m$^2$<br>Gelatin 1,500 mg/m$^2$<br>Yellow coupler [α-pivaloyl-α-(2,4-dioxo-5,5'-dimethyloxazolidin-3-yl)-2-chloro-5-(α-2,4-di-t-amylphenoxy)-butanamide)acetanilide]<br>600 mg/m$^2$<br>Coupler solvent (trinonyl phosphate)<br>300 mg/m$^2$ |
| Base | Polyethylene laminated paper. |

After comparative compounds or the high molecular compounds of the present invention were added to the 1st layer (blue-sensitive layer) as shown in Table 3, 4-hydroxy-6-methyl-1,3,3a,7-tetraazaindene was added to the 1st layer and the 3rd layer. Further, coating aids (sodium dodecylbenzenesulfonate and sodium p-nonylphenoxypoly(ethyleneoxy)propanesulfonate) were added to each layer and a hardener (2,4-dichloro-6-hydroxy-1,3,5-triazine sodium salt) was added to the 4th layer. They were applied and dried to obtain Samples 21 to 27.

The samples were then exposed to light through an optical wedge by means of a sensitometer, and subjected to the following development processing. Photographic properties of the blue-sensitive layer (yellow) and the green-sensitive layer (magenta) were measured to obtain the results (sensitivity and stain) shown in Table 3.

The condition of development processing in Example 3 is as follows.

| Step | Time | Temperature |
|---|---|---|
| Color development | 3 min 30 sec | 33° C. |
| Bleach-fixing | 1 min 30 sec | " |
| Water wash | 2 min | " |
| Drying | | |

-continued

| Step | Time | Temperature |
|---|---|---|
| Composition of the Color Developing Solution: | | |
| Benzyl alcohol | | 15 ml |
| Sodium sulfite | | 5 g |
| Potassium bromide | | 0.5 g |
| Hydroxylamine sulfate | | 2.0 g |
| Sodium carbonate | | 30.0 g |
| Sodium nitrilotriacetate | | 2.0 g |
| 4-Amino-3-methyl-N—(β-methanesulfonamide)ethylaniline | | 5.0 g |
| Water to make | | 1,000 ml |
| | | pH: 10.1 |
| Composition of the Bleach-Fixing Solution: | | |
| Ammonium thiosulfate | | 105 g |
| Sodium sulfite | | 2 g |
| EDTA disodium salt | | 40 g |
| Sodium carbonate ($H_2O$) | | 5 g |
| Water to make | | 1,000 ml |
| | | ph: 7.0 |

Further, the sensitivity is indicated as the reciprocal of logarithm of an exposure amount necessary to obtain a density of stain +0.2, which is shown as relative values on the basis of the sensitivities of the yellow color formed layer and the magenta color formed layer of Sample No. 21 as being 100.

TABLE 3

| Sample No. | Compound Added | Amount Added (g/mol AgX) | Yellow Color Formed Layer (the 1st layer) Relative Sensitivity | Yellow Stain Density | Magenta Color Formed Layer (the 3rd layer) Relative Sensitivity | Magenta Stain Density |
|---|---|---|---|---|---|---|
| 21 | (control) | — | 100 | 0.09 | 100 | 0.08 |
| 22 | Comparative Compound B | 3.9 | 65 | 0.09 | 75 | 0.08 |
| 23 | Polymer 1-5 | 3.0 | 75 | 0.09 | 95 | 0.08 |
| 24 | Polymer 1-5 | 9.8 | 58 | 0.09 | 90 | 0.08 |
| 25 | Polymer 1-2 | 16.1 | 70 | 0.09 | 95 | 0.08 |
| 26 | Polymer 4-1 | 18.3 | 60 | 0.08 | 88 | 0.08 |
| 27 | Polymer 7-2 | 9.5 | 72 | 0.09 | 98 | 0.08 |

As is obvious from Table 3, the comparative Compound B easily diffuses to cause reduction of the sensitivity of the green sensitive layer, even if it is added to the blue-sensitive layer. Further, if it is intended to reduce the yellow stain, the sensitivity of the green-sensitive layer is always remarkably reduced at the same time.

On the contrary, the high molecular compounds of the present invention (Sample Nos. 23 to 27) have nearly the same effect of preventing yellow stain of the blue-sensitive layer as compared with the comparative compound. Further, reduction of the sensitivity of the green-sensitive layer is pretty small as compared with the case of using the comparative compound, because of causing less diffusion between the layers, and it is thus possible to use it for only the desired layer.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material, comprising:

a support base having thereon:

a silver halide emulsion layer; and a high molecular compound having a repeating unit being represented by the formula (I)

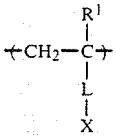

(I)

wherein $R^1$ represents a hydrogen atom or a lower alkyl group, L represents a divalent bonding group, and X represents a monovalent group of benzotriazoles, wherein the high molecular compound in present in an anti-fogging or stabilizing amount 2. A silver halide photographic light-sensitive material as claimed in claim 1, wherein $R^1$ represents a hydrogen atom or an alkyl group containing 1 to 6 carbon atoms.

3. A silver halide photographic light-sensitive material as claimed in claim 1, wherein $R^1$ represents a hydrogen atom or a methyl group.

4. A silver halide photographic light-sensitive material as claimed in claim 1, wherein L contains 1 to 20 carbon atoms.

5. A silver halide photographic light-sensitive material as claimed in claim 1, wherein the divalent bonding group is represented by the formulae (L-I) or (L-II)

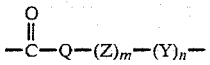

(L-I)

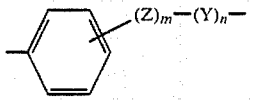

(L-II)

wherein Q represents

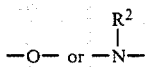

in which $R^2$ represents a hydrogen atom or a lower alkyl group; Z represents an alkylene group or an arylene group; Y represents —COO—, —OCO—, —CONH—, —NHCO—, —$SO_2$NH— or —NH$SO_2$—; and m and n represents 0 or an integer of 1.

6. A silver halide photographic light-sensitive material as claimed in claim 1, wherein the monovalent group of benzotriazole is a group represented by the general formula (II)

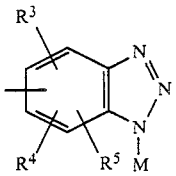

(II)

wherein M represents a hydrogen atom, an alkali metal atom, or a protective group capable of being cleaved by an alkali; and $R^3$, $R^4$ and $R^5$, which may be identical or different, each represents a hydrogen atom, a substituted or nonsubstituted alkyl group, a substituted or nonsubstituted aryl group, a halogen atom, a nitro group, a substituted or nonsubstituted alkoxy group, or a cyano group.

7. A silver halide photographic light-sensitive material as claimed in claim 1, wherein the high molecular compound has a molecular weight in the range of $5\times10^3$ to $3\times10^6$.

8. A silver halide photographic light-sensitive material as claimed in claim 1, wherein the high molecular compound includes the repeating unit of the general formula (I) in an amount of 0.1% by mol or more.

9. A silver halide photographic light-sensitive material as claimed in claim 8, wherein the high molecular compound contains the repeating unit of the general formula (I) in an amount of 1% by mol or more.

10. A silver halide photographic light-sensitive material as claimed in claim 1, wherein the high molecular compound is present in an amount in the range of $10^{-8}$ mol to $10^{-3}$ mol, calculated as the number of mols of the mino-valent group of benzotriazoles contained in the high molecular compound, per 1 $m^2$ of support base.

11. A silver halide photographic light-sensitive material as claimed in claim 10, wherein the high molecular compound is present in an amount in the range of $10^{-7}$ mol to $5\times10^{-4}$ mol, calculated as the number of mols of the mono-valent group of benzotriazoles contained in the high molecular compound per 1 $m^2$ of support base.

12. A silver halide photographic light-sensitive material as claimed in claim 1, wherein the high molecular compound is present in an amount in the range of about 0.02 mg to about 2 g per 1 $m^2$ of support base.

13. A silver halide photographic light-sensitive material as claimed in claim 12, wherein the high molecular compound is present in an amount in the range of about 0.2 mg to about 1 g per 1 $m^2$ of support base.

14. A silver halide photographic light-sensitive material as claimed in claim 1, wherein the high molecular compound is present in an amount in the range of from about 60 mg to about 200 g per mol of silver halide.

15. A silver halide photographic light-sensitive material as claimed in claim 14, wherein the high molecular compound is present in an amount in the range of from about 300 mg to about 100 g per mol of silver halide.

* * * * *